US006120395A

United States Patent [19]

Dorenbusch

[11] Patent Number: 6,120,395

[45] Date of Patent: Sep. 19, 2000

[54] TEMPORARY REARRANGEABLE MARKING SYSTEM

[76] Inventor: Charles B. Dorenbusch, 9208 Link Rd., Loveland, Ohio 45140

[21] Appl. No.: 09/161,130

[22] Filed: Sep. 25, 1998

[51] Int. Cl.[7] ..... A63B 67/00

[52] U.S. Cl. ..... 473/465; 473/490

[58] Field of Search ..... 473/465, 490, 473/422, 452, 472, FOR 100, FOR 101; 428/172

[56] References Cited

U.S. PATENT DOCUMENTS

| | | | |
|---|---|---|---|
| 2,077,617 | 4/1937 | Cramer | 264/255 |
| 2,458,984 | 1/1949 | Engle . | |
| 3,081,090 | 3/1963 | Congleton . | |
| 3,896,248 | 7/1975 | Scarpa | 428/172 |
| 3,968,968 | 7/1976 | Peterson . | |
| 4,385,586 | 5/1983 | Schriever . | |
| 4,687,369 | 8/1987 | McDonald | 404/12 |
| 5,309,863 | 5/1994 | Leeb, Jr. . | |
| 5,356,132 | 10/1994 | McEwan et al. . | |
| 5,474,301 | 12/1995 | Wilson . | |
| 5,613,855 | 3/1997 | Thompson et al. . | |
| 5,741,194 | 4/1998 | Simunek . | |
| 5,800,297 | 9/1998 | Aldstadt | 473/490 |
| 5,928,095 | 7/1999 | Aldstadt | 473/490 |
| 5,935,025 | 8/1999 | Aldstadt | 473/490 |
| 5,942,311 | 8/1999 | Scianna | 428/195 |

*Primary Examiner*—Jeanette Chapman
*Assistant Examiner*—M. Chambers
*Attorney, Agent, or Firm*—Charles R. Wilson

[57] ABSTRACT

A rearrangeable marking system for a hard floor or ground surface comprises a set of individual spot markers. Each spot marker is made of a synthetic polymeric material. The markers have a substantially flat low profile and a non-slip bottom surface. All peripheral edges are beveled downwardly. The individual spot markers resist lateral forces yet are readily placed on the surface and readily lifted from the surface. The spot markers are for temporarily marking a surface for a practice drill in a manner whereby the spot markers do not interfere or hinder the drill.

14 Claims, 3 Drawing Sheets

TEMPORARY REARRANGEABLE MARKING SYSTEM

FIELD OF THE INVENTION

This invention relates to a marking system. More particularly, the invention relates to a rearrangeable marking system for temporarily marking a spot on a hard floor or ground surface without interfering with normal use of the surface.

BACKGROUND OF THE INVENTION

Certain sports such as basketball, volleyball, and indoor soccer are played on a hard surface court. A court dedicated to one sport will have boundary lines and interior play areas permanently marked off to indicate a defined spot or area which is dictated by that sport's rules. For example, a basketball court has out-of-bounds boundary lines, a half-court line, a jump circle line, a three-point line and free-throw lines. All the aforementioned lines are permanently marked on the court surface, normally by paint. They are permanent. A court used for two sports such as basketball and volleyball may have all the lines needed by both sports permanently marked. The lines of the sport not being played are simply ignored. Alternatively, a temporary marking system may be used for the lesser used of the two sports. For example, a court primarily used for basketball can have a line defined by black adhesive tape temporarily positioned on it to define a volleyball court.

Temporary boundary lines or spots are often used on the courts during practice drills. The lines or spots serve as an aid in coaching a particular player activity. Any such line or spot must be temporary. Brightly colored cones made of a soft plastic have been extensively used. They are readily visible. However, they are bulky and, while useful for temporarily marking an area or spot, interfere with normal play and are easy to trip over because of their size. Brightly colored pieces of tape have also been used, but are time consuming to apply and can be difficult to remove. Furthermore, they typically leave a sticky residue which then creates a surface which is unsuitable for safe pay.

In accord with a demonstrated need, there has now been developed a marking system for temporarily marking a hard surface floor. The marking system is readily positioned, is readily repositioned as desired, does not interfere with normal play or use, remains in place without being dislodged, and is readily removed when no longer needed.

SUMMARY OF THE INVENTION

A rearrangeable marking system for temporarily marking a defined area on a hard floor or ground surface comprises a se of spot markers. Each spot marker is made of a synthetic polymeric material. Each spot marker has a substantially flat low profile with all peripheral edges beveled downwardly. The spot markers are pliable and have a non-slip bottom surface which resists lateral forces to remain in place during use, yet are readily lifted from the surface when no longer needed. The spot markers are very visible, yet do not interfere with normal play or surface use.

DETAILED DESCRIPTION OF THE INVENTION

Figure 1:
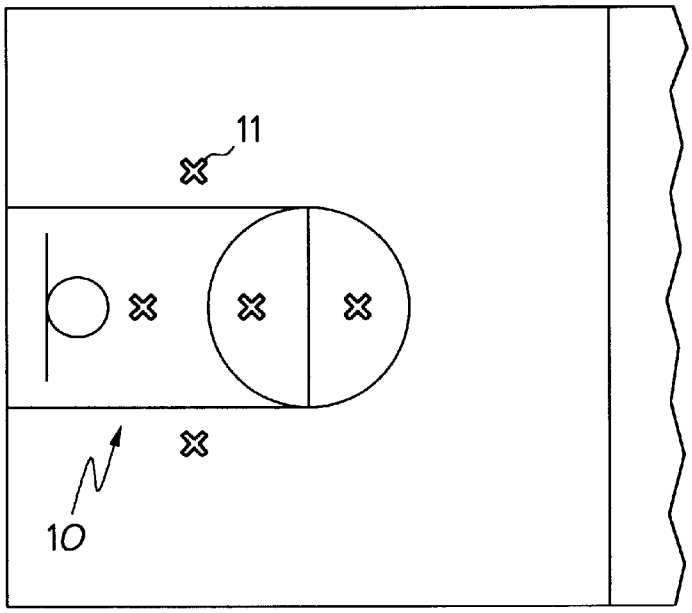
FIG. 1 is an environmental view of a basketball half-court with spot markers of the marking system of the invention in place for a drill.

The marking system of the invention is intended for use on hard floor or ground surfaces that have a substantially smooth top surface. The marking system is primarily useful on hardwood floor surfaces such as basketball courts. The use of the marking system of the invention is described below and in the drawings with reference to this prime use. The marking system of the invention is useful with other hard surfaces, including concrete or asphalt playground surfaces. The marking system is also used with other sports, recreational games, stage plays and other activities where a temporary marking system is needed or desired.

Figure 2:
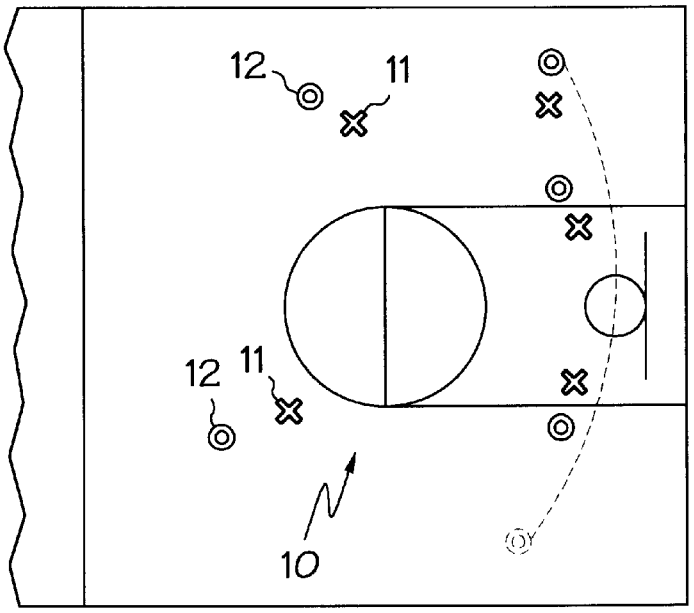
FIG. 2 is an environmental view of a basketball half-court showing another player arrangement using the spot markers of the invention.

With reference to FIGS. 1 and 2, there are shown basketball half-courts with the marking system 10 of the invention in position. The marking system 10 comprises a set of X-shaped spot markers 11 to designate defensive players and a set of O-shaped spot markers 12 to designate offensive players. In FIG. 1, X-shaped spot markers 11 are placed on the court's floor surface to show defensive players where they should be positioned in a 1-3-1 zone defensive scheme. In FIG. 2, O-shaped spot markers 12 are positioned on the court's floor surface to show offensive player starting positions for a play pattern to be run. Defensive X-shaped markers are appropriately positioned as well. A sixth O-shaped marker shown in phantom is placed on the floor surface to show a play ending position for one of the offensive players. The X-shaped spot markers 11 and the O-shaped spot markers 12 differ only in their shape. Their physical characteristics and properties are the same as further discussed below.

The individual spot markers are made of a synthetic polymeric material which, in the shape and thickness contemplated, is pliable. A degree of pliability is needed for the markers to lie flat on the floor, i.e. in effect to conform to the floor surface. Several classes of synthetic polymeric materials can be used including polyvinylchlorides, polyurethanes, polypropylenes, polyethylenes and synthetic rubbers. The polyvinylchlorides are preferred because of cost, moldability, durability and performance reasons. Preferably, the synthetic polymeric material inherently has a non-slip physical characteristic as further discussed below.

Figure 3:
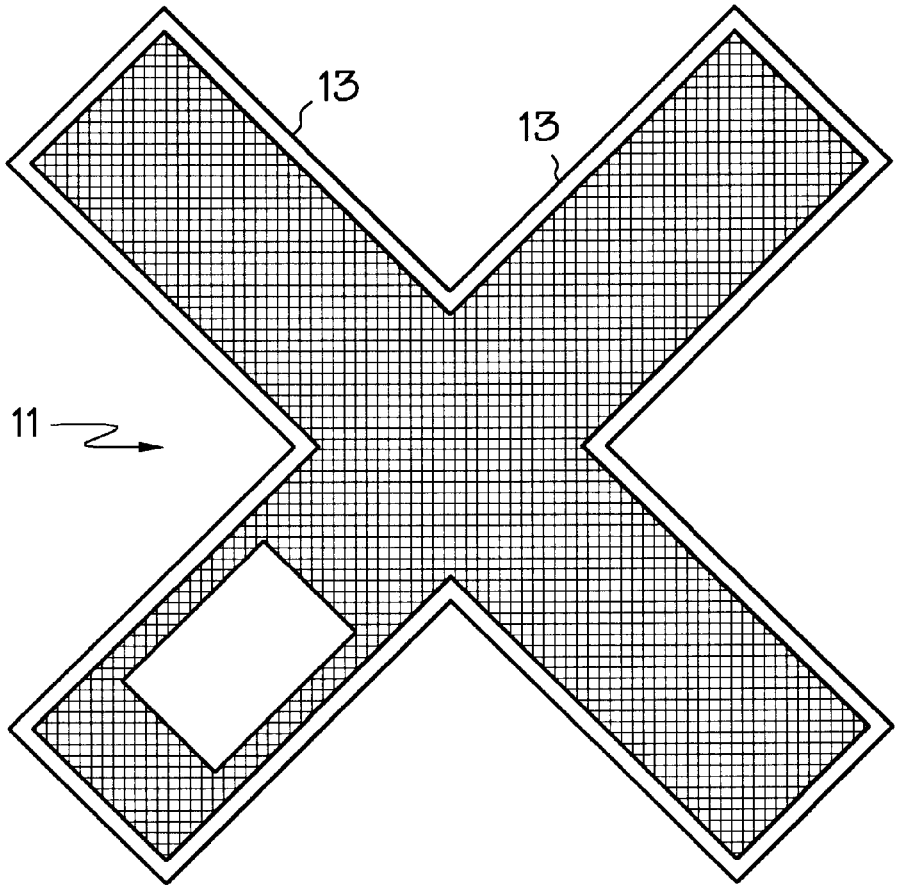
FIG. 3 is a top plan view of a spot marker of the marking system of FIG. 1 having an X-shape.
Figure 4:
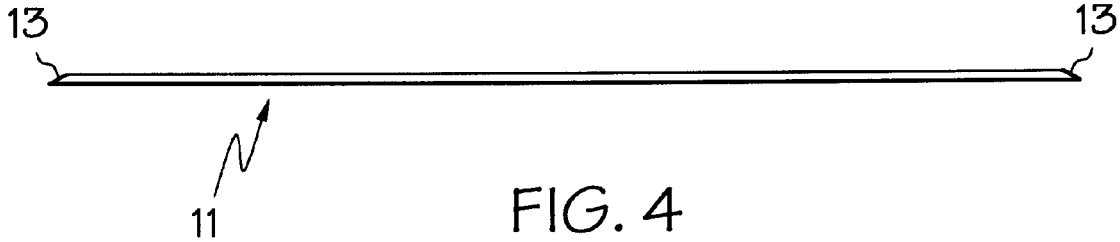
FIG. 4 is a side elevational view of the spot marker of FIG. 3.

As best seen in FIGS. 3 and 4, the X-shaped spot marker 11 has a substantially flat low profile with beveled peripheral edges 13. The marker's low profile is needed to ensure that players do not trip or stumble when contact is made with one or more of the spot markers. The spot marker 11 preferably has a thickness of from about 100 mils to about 300 mils. A lesser thickness is generally avoided due to the need for the spot marker to have sufficient bulk or weight to remain in place once properly positioned. To further aid in making the spot marker non-interfering, all peripheral edges are beveled downwardly to present a gently rising edge area. Preferably, the peripheral edges are angled downwardly towards the floor to create an about 30 degree to about 60 degree angle to the horizontal.

As evident in FIG. 3, a top surface of the X-shaped spot marker is preferably textured. The roughened surface caused by the texturing provides a degree of anti-skid to the top surface in case a player steps on the spot marker.

The X-shaped spot marker 11 has two legs each of which ranges from about five inches to about fifteen inches in length. Preferably, for best visibility and least play interference, each leg is from about eight inches to about twelve inches in length.

Figure 5:
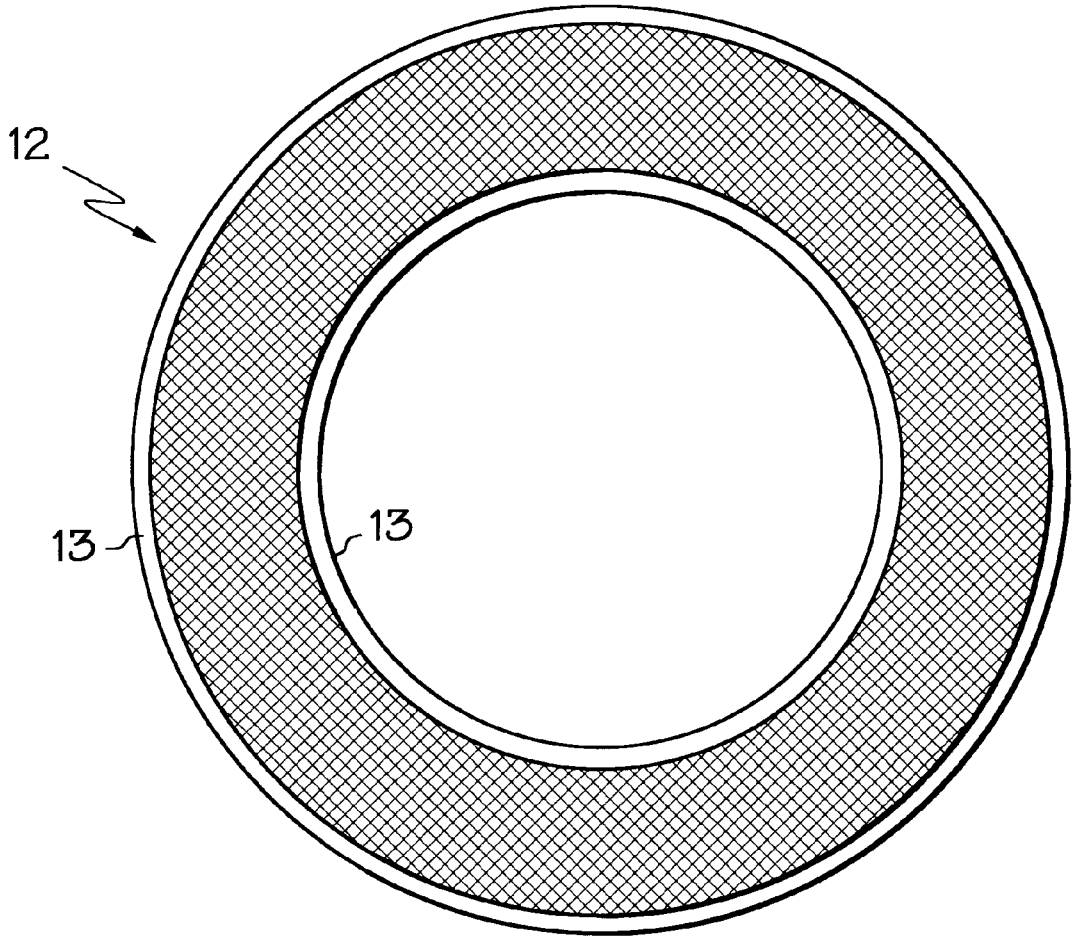
FIG. 5 is a top plan view of a spot marker of the marker system of FIG. 2 having an O-shape.
Figure 6:
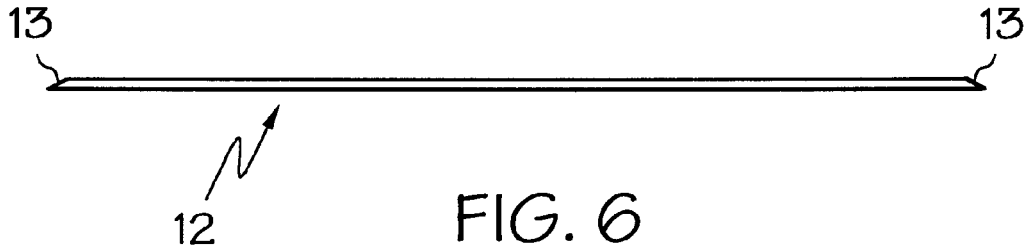
FIG. 6 is a side elevational view of the spot marker of FIG. 5.

FIG. 5 and 6 illustrate the O-shaped spot markers 12 of the marking system 10. The spot marker 12 has an outside diameter of from about five inches to about fifteen inches, preferably from about eight inches to about twelve inches. The low profile, beveled peripheral edges and polymeric material used in its construction are the same as described above with respect to the X-shaped spot marker 11.

While not shown, a thin layer of an adhesive can be applied to the underside of each spot marker. The adhesive enhances the spot marker's surface non-slip characteristic. An adhesive with a low degree of adhesion is used so as not to unduly make difficult the spot marker's removal from the surface.

In use, the spot markers 11 and 12 are placed on the basketball court to designate a "starting point" area for all the players or an "ending point" area for all or at least the offensive players. The spot markers are easily placed simply by dropping them right side up directly down onto the floor surface. The spot markers are readily visible to the players. However, their low profile, beveled edges and non-slip bottom surface ensure that they do not interfere with the playing action. That is, the individual players can easily step over them. They can also step on the spot markers without fear of the markers laterally moving to cause the player to slip or fall. At the end of the practice drill, the spot markers are simply lifted and rearranged, moved or stored as desired.

The above described X-shaped and O-shaped spot markers can be used in practice drills for other sports such as volleyball and indoor soccer. The spot markers also can be used to temporarily mark a "take-off" or "land" spot for a gymnast. The rearranging characteristics of the spot markers allow them to be constantly moved to fit the particular gymnast who is performing. The spot markers of FIGS. 3–5 also are useful in non-sport activities. For example, a hard surface such as a school stage can beneficially be temporarily marked with the spot markers to designate stage markers for plays, dances and recitals. Still other uses for the spot markers are possible and will be readily apparent to users of hard floor or ground surfaces.

Other shaped spot markers are contemplated for a variety of uses. The shape is normally dictated by end use for the markers or by tradition such as the above described X's and O's or basketball. For example, the spot markers can also be used to temporarily mark a concrete or asphalt driveway for parallel parking practice. Such spot markers are rectangular-shaped with a length of up to about twenty feet and a width of about four inches to about six inches. Other shapes including triangular, oval, star, and diamond are feasible. The spot markers can be brightly colored for better visibility or coated with a phosphorescent paint for night viewing. They can also be color coded to further denote player or participant directives.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A rearrangeable marking system for temporarily marking a defined area on a hard floor or ground surface without interfering with use of the surface, said rearrangeable marking system comprising a set of individual spot markers with each said individual spot marker made of a synthetic polymeric material, each said individual spot marker further having (i) a substantially flat low profile with a thickness of from about 100 mils to about 300 mils, (ii) peripheral edges beveled downwardly at an about 30 degree to about 60 degree angle to the horizontal, (iii) a non-slip bottom surface for resisting lateral forces, and (iv) a textured top surface, whereby each said individual spot marker when placed on the surface resists lateral forces to remain in place yet is readily lifted from the surface for movement to another area or to storage.

2. The rearrangeable marking system of claim 1 wherein each of the spot markers is made of polyvinylchloride.

3. The rearrangeable marking system of claim 1 wherein at least one spot marker is X-shaped.

4. The rearrangeable marking system of claim 1 wherein at least one spot marker is O-shaped.

5. The rearrangeable marking system of claim 1 wherein each spot marker is pliable.

6. The rearrangeable marking system of claim 1 wherein each spot marker has a substantially smooth bottom surface.

7. A rearrangeable marking system for temporarily marking a defined area on a hardwood floor surface without interfering with use of the surface, said rearrangeable marking system comprising a set of individual X-shaped spot markers and a set of individual O-shaped spot markers with each said individual spot marker made of a synthetic polymeric material and further each said individual spot marker having (i) a substantially flat low profile with a thickness of about 100 mils to about 300 mils, (ii) a substantially smooth non-slip bottom surface, (iii) peripheral edges downwardly beveled to an about 30 degree to an about 60 degree angle to the horizontal, and (iv) a textured non-interfering top surface, whereby each said individual spot marker when placed on the surface resists lateral forces to remain in place yet is readily lifted from the surface for movement to another area or to storage.

8. The rearrangeable marking system of claim 7 wherein each of the spot markers is made of polyvinylchloride.

9. The rearrangeable marking system of claim 7 wherein the individual X-shaped spot markers each have two legs and each leg ranges from about five inches to about fifteen inches in length and the individual O-shaped spot markers each have outside diameters of from about five inches to about fifteen inches.

10. The rearrangeable marking system of claim 9 wherein each spot marker is made of a pliable synthetic rubber.

11. A rearrangeable marking system for temporarily marking a defined area on a hardwood floor surface without interfering with use of the surface by sports participants, said rearrangeable marking system comprising a set of individual X-shaped spot markers and a set of individual O-shaped spot markers with each said individual spot marker made of a pliable synthetic rubber and further each said individual spot marker having (i) a substantially flat low profile with a thickness of about 100 mils to about 300 mils, (ii) a substantially smooth non-slip bottom surface, and (iii) peripheral edges downwardly beveled, whereby each said individual spot marker when placed on the surface resists lateral forces by the sports participants to remain in place yet is readily lifted from the surface for movement to another area or to storage.

12. The rearrangeable marking system of claim 11 further wherein each of the individual spot makers has a top surface physically roughened to give a textured surface which is non-interfering with action by the sports participants.

13. The rearrangeable marking system of claim 12 wherein the peripheral edges of each said individual spot marker are downwardly beveled at an about 30 degree to an about 60 degree angle to the horizontal.

14. The rearrangeable marking system of claim 13 wherein the individual X-shaped spot markers each have two legs and each leg ranges from about five inches to about fifteen inches in length and the individual O-shaped spot markers each have outside diameters of from about five inches to about fifteen inches.

* * * * *